US010919139B2

(12) United States Patent
Andersen et al.

(10) Patent No.: US 10,919,139 B2
(45) Date of Patent: Feb. 16, 2021

(54) REMOTE WRENCH HANDLE AND ACCESSORIES

(71) Applicant: Snap-on Incorporated, Kenosha, WI (US)

(72) Inventors: Jonathan I. Andersen, Racine, WI (US); Anup A. Gupte, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 302 days.

(21) Appl. No.: 15/938,205

(22) Filed: Mar. 28, 2018

(65) Prior Publication Data

US 2018/0207786 A1 Jul. 26, 2018

Related U.S. Application Data

(62) Division of application No. 14/918,762, filed on Oct. 21, 2015.

(60) Provisional application No. 62/116,996, filed on Feb. 17, 2015.

(51) Int. Cl.

| | |
|---|---|
| ***B25B 13/48*** | (2006.01) |
| ***B25B 17/00*** | (2006.01) |
| ***B25G 1/04*** | (2006.01) |

(52) U.S. Cl.

CPC ..... *B25G 1/043* (2013.01); *B25B 13/481* (2013.01); *B25B 17/00* (2013.01)

(58) Field of Classification Search

CPC ..... B25G 1/043; B25G 1/04; B25B 13/481; B25B 17/00; B25B 13/467; B25B 17/02; B25B 21/002; B25B 13/48; B25B 13/5091; B25B 13/486; E21B 19/16

See application file for complete search history.

(56) References Cited

U.S. PATENT DOCUMENTS

| | | | |
|---|---|---|---|
| 1,109,032 | A | 9/1914 | Bersted |
| 1,144,907 | A | 6/1915 | Knipple |
| 1,379,536 | A | 5/1921 | Davies |
| 1,384,887 | A | 7/1921 | Burndahl |
| 1,568,442 | A | 1/1926 | Carver |
| 1,747,527 | A | 2/1930 | Peterson |
| 1,840,685 | A | 1/1932 | Witherup |
| 2,466,456 | A | 4/1949 | Lybyer |

(Continued)

FOREIGN PATENT DOCUMENTS

| | | |
|---|---|---|
| CN | 2882909 | 3/2007 |
| CN | 201881309 | 6/2011 |

(Continued)

OTHER PUBLICATIONS

AU Examination Report No. 1 for Application No. 2019200644, dated Aug. 20, 2019, 6 pages.

(Continued)

*Primary Examiner* — Robert J Scruggs
(74) *Attorney, Agent, or Firm* — Seyfarth Shaw LLP

(57) ABSTRACT

Handles and other accessories for a remote or extension wrench that assists the user better control and maneuver the remote wrench relative to a work piece. For example, the remote wrench housing can include a handle that is coupled to the remote wrench. The handle can also be rotatable relative to the remote wrench and positionable at a desired angle of rotation for improved maneuverability.

8 Claims, 6 Drawing Sheets

(56) References Cited

U.S. PATENT DOCUMENTS

| | | | | |
|---|---|---|---|---|
| 3,564,953 | A | 2/1971 | Able | |
| 3,706,244 | A * | 12/1972 | Wilmeth | B25B 21/002 81/57.32 |
| 4,027,560 | A * | 6/1977 | Parker | B25B 21/002 81/57.39 |
| 4,063,475 | A | 12/1977 | Perkins | |
| 4,098,151 | A | 7/1978 | Bliss | |
| 4,231,271 | A * | 11/1980 | Yamada | B25B 13/481 81/57.3 |
| 4,304,157 | A | 12/1981 | Yamada et al. | |
| 4,374,480 | A | 2/1983 | Diaz | |
| 4,492,133 | A | 1/1985 | Schosek | |
| 4,676,703 | A | 6/1987 | Swanson | |
| 4,735,118 | A | 4/1988 | Broemel, Jr. | |
| 4,825,729 | A | 5/1989 | Puncochar | |
| 4,827,809 | A | 5/1989 | Broemel, Jr. | |
| 4,867,016 | A | 9/1989 | Di Edwardo | |
| 5,074,170 | A | 12/1991 | Shirley | |
| 5,732,605 | A | 3/1998 | Mann | |
| 6,000,299 | A | 12/1999 | Cole | |
| 6,032,555 | A | 3/2000 | Whitley | |
| 6,101,907 | A | 8/2000 | McGovern et al. | |
| 6,161,982 | A | 12/2000 | Cole | |
| 6,216,565 | B1 | 4/2001 | McCann | |
| 6,647,830 | B2 * | 11/2003 | Marquardt | B23Q 5/045 81/57.3 |
| 6,651,532 | B1 | 11/2003 | Whitelock | |
| 6,752,048 | B1 | 6/2004 | Chiang | |
| 6,832,531 | B1 | 12/2004 | Marquardt | |
| 6,840,141 | B2 | 1/2005 | Cole | |
| 6,923,094 | B1 | 8/2005 | Marquardt | |
| 6,945,139 | B1 | 9/2005 | Johnson | |
| 7,201,085 | B1 | 4/2007 | Hsieh | |
| 7,246,545 | B1 | 7/2007 | Lee | |
| 7,302,876 | B1 | 12/2007 | Lee | |
| 7,373,861 | B2 | 5/2008 | Hsieh | |
| 7,591,208 | B2 | 9/2009 | Cole | |
| 7,703,356 | B2 | 4/2010 | Bass | |
| 7,827,885 | B2 | 11/2010 | Rowell | |
| 8,347,763 | B1 | 1/2013 | Chu | |
| 8,516,927 | B1 | 8/2013 | Wang | |
| 8,757,032 | B2 | 6/2014 | Shu-Ju | |
| 2009/0084230 | A1 | 4/2009 | Selgas | |
| 2009/0107301 | A1 | 4/2009 | Lambert | |
| 2009/0241740 | A1 | 10/2009 | Heagerty | |
| 2011/0000342 | A1 | 1/2011 | Lambert et al. | |
| 2013/0032007 | A1 | 2/2013 | Chen | |

FOREIGN PATENT DOCUMENTS

| | | |
|---|---|---|
| CN | 203109870 | 8/2013 |
| CN | 203557319 | 4/2014 |
| CN | 204076134 | 1/2015 |
| GB | 176174 | 3/1922 |
| JP | 2015100891 | 6/2015 |
| TW | 250730 | 7/1995 |
| TW | 369977 | 9/1999 |
| TW | 380473 | 1/2000 |
| TW | M430598 | 4/2001 |
| TW | M252504 | 12/2004 |
| TW | M311531 | 5/2007 |
| TW | M312394 | 5/2007 |
| TW | M312395 | 5/2007 |
| TW | M344948 | 11/2008 |
| TW | M406495 | 7/2011 |
| TW | M444249 | 1/2013 |
| TW | 201307012 | 2/2013 |
| TW | I398326 | 6/2013 |
| TW | M477942 | 5/2014 |
| TW | 449604 | 8/2014 |
| WO | 1999052683 | 10/1999 |

OTHER PUBLICATIONS

AU Examination Report No. 1 for Application No. 2019200531, dated Jul. 29, 2019, 4 pages.
CN Office Action for Application No. 201610086989.1, dated Aug. 30, 2019, 4 pages.
Chinese Office Action for Application No. 201610086989.1 dated Feb. 14, 2018, 3 pages.
UK Combined Search and Examination Report for Application No. 1713101.2 dated Feb. 6, 2018, 5 pages.
Australian Examination Report for Application No. 2017203176 dated Jan. 25, 2018, 4 pages.
United Kingdom Examination Report for Application No. GB1602696.5 dated Sep. 26, 2017, 4 pages.
Chinese Office Action for Application No. 201610086989.1 dated May 26, 2017, 8 pages.
English Translation of Chinese Office Action for Application No. 201610086989.1 dated May 26, 2017, 3 pages.
Taiwan Patent Office, Office Action dated Sep. 19, 2016; 10 pages.
United Kingdom Intellectual Property Office Combined Search and Examination Report, dated Jun. 15, 2016; 8 pages.
Australian Government Patent Examination Report No. 1 dated May 12, 2016, 5 pages.
Fourth Office Action for Chinese Application No. 2016100869891 dated May 5, 2019, 3 pages.
UK Office Action for Application No. 1602696.5, dated Aug. 15, 2018, 4 pages.
Chinese Third Office Action for Application No. 201610086989.1 dated Oct. 8, 2018, 2018, 8 pages.
AU Examination Report No. 2 for Application No. 2019200531, dated Jun. 4, 2020, 3 pages.
AU Examination Report No. 3 for Application No. 2019200531, dated Jul. 13, 2020, 3 pages.

* cited by examiner

REMOTE WRENCH HANDLE AND ACCESSORIES

CROSS-REFERENCE TO RELATED APPLICATIONS

The present application is a divisional of and claims priority to U.S. patent application Ser. No. 14/918,762, filed on Oct. 21, 2015, entitled Remote Wrench Handle and Accessories, which claims priority to U.S. Provisional Patent Application No. 62/116,996, filed Feb. 17, 2015, entitled Remote Wrench Handle and Accessories, the contents of which are incorporated by reference herein in their entirety.

TECHNICAL FIELD OF THE INVENTION

The present application relates generally to remote wrenches. More particularly, the present application relates to handles and other accessories for remote wrenches and similar tools.

BACKGROUND OF THE INVENTION

Remote, or extension, wrenches are commonly used to gain access to hard to reach places in a vehicle or other workspace. Remote wrenches include an input on a first end for receiving torque from a tool (e.g., a ratchet or torque wrench), and an output on an opposing, distal second end for transferring the torque to a work piece (e.g., nut or bolt) in a hard to reach or otherwise inaccessible area. The input and output are typically operably coupled by a chain and sprocket system or gear train to transfer the torque between the input and output, efficiently connecting the tool to the work piece.

Remote wrenches can sometimes be difficult to maneuver and position within the desired space. For example, remote wrenches can become disengaged from a work piece or misaligned when applying torque to the work piece, causing inconvenience or a misapplication of torque.

SUMMARY OF THE INVENTION

The present invention broadly comprises a handle and other accessories for a remote wrench that assist a user maneuver and position the remote wrench in a desired configuration relative to a work piece. The handle can be coupled to the remote wrench at a point spaced from the input or output of the remote wrench to interfere with the remote wrench operation. The handle can also be rotatable relative to the remote wrench and fixedly positionable at a desired angle of rotation. Such a configuration allows the user to keep their hands away from potentially dangerous mechanical working areas where injury may occur, and further allows the user to reach hard to access areas with greater control over the torque application process.

In an embodiment, the present invention broadly comprises a tool adapted to be coupled to an accessory and includes a housing having first and second ends with respective input and output. The input is adapted to receive and transfer a torque to the output, and the output is adapted to transmit the torque to a work piece. A connection point is spaced from the input and output, and is coupled to the accessory.

In another embodiment, the present invention broadly comprises a tool and accessory combination that includes a tool having first and second ends with respective input and output, where the input is adapted to receive and transfer a torque to the output, and the output is adapted to transmit the torque to a work piece, and a connection point for connecting to an accessory, where the connection point is spaced from the input and output. The accessory can be coupled to the tool at the connection point.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
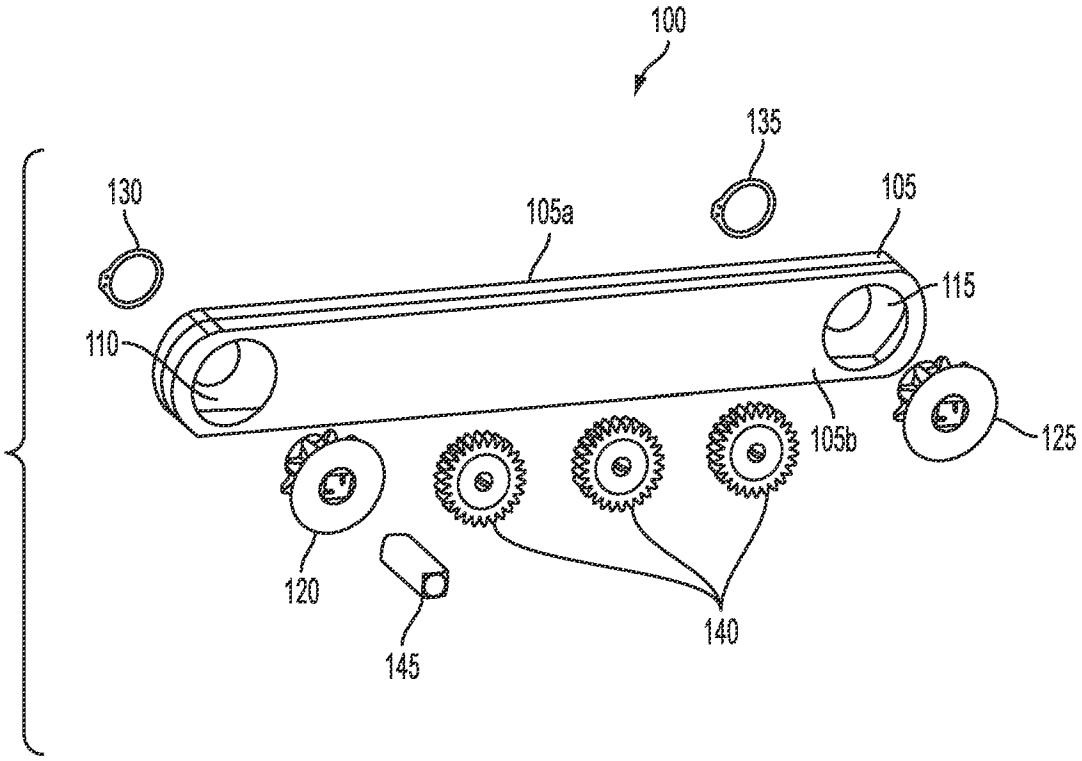
FIG. 1 is an exploded, perspective side view of a remote wrench according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises handles and other accessories for a remote or extension wrench. The handles and accessories assist a user maneuver and control the remote wrench to improve the torque application process to a work piece. The handle can be coupled to the remote wrench over the input or output of the remote wrench, or can be coupled to the remote wrench at any intermediate or exterior position to not interfere with the remote wrench operation. The handle can also rotate relative to the remote wrench or be positionable at a desired angle of rotation.

Figure 2:
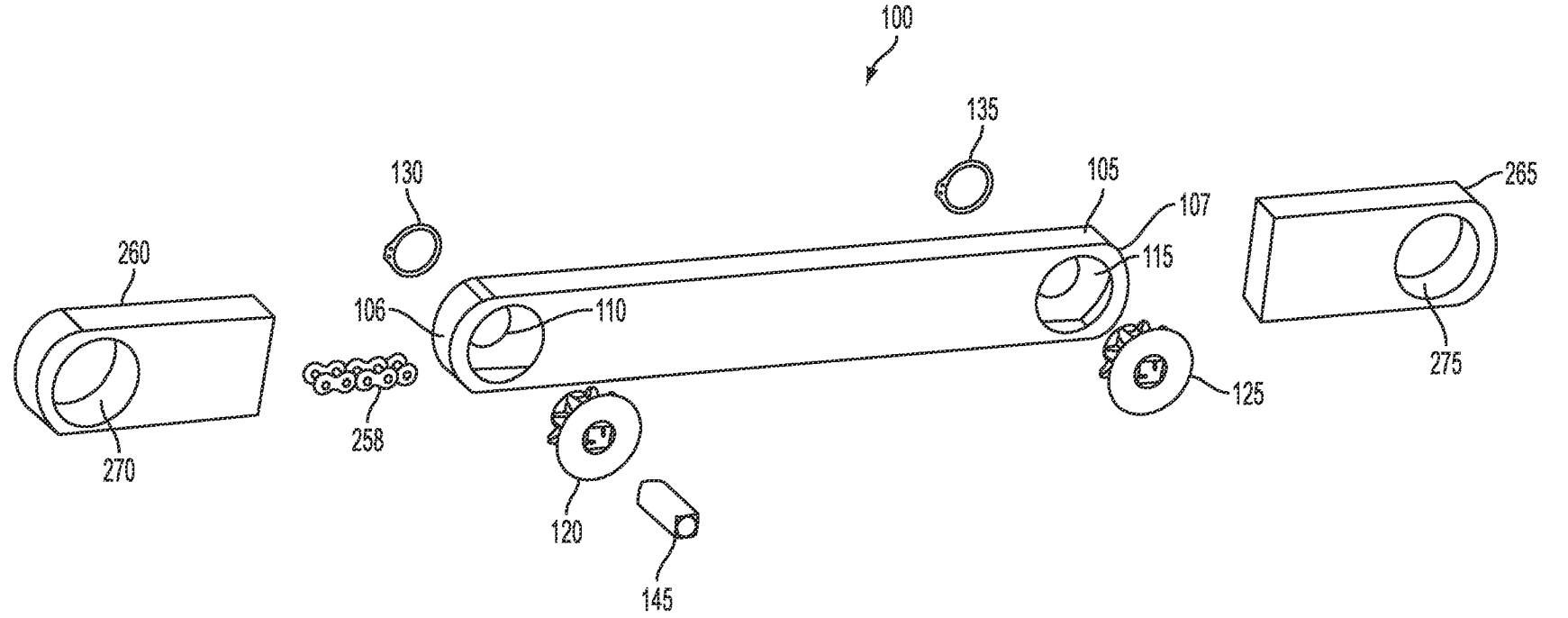
FIG. 2 is an exploded, perspective side view of a remote wrench according to another embodiment of the present invention.

Referring to FIGS. 1 and 2, a tool 100 can include a housing 105 with a first portion 105*a* and a second portion 105*b* coupled together by known fastening means, such as a fastener, adhesive, or any other form of clamshell housing fastening means, with a cavity defined therein. In an embodiment, the housing 105 can be constructed of a unitary, one-piece body having a cavity. The housing 105 can define a first opening 110 and an opposing second opening 115, sized and shaped to respectively axially receive an output 120 and an input 125. The output 120 and input 125 can be respectively coupled within the first and second openings 110, 115 with respective first clip 130 and second clip 135, and are rotatable relative to the housing. In some embodiments, intermediate gears 140 can operably couple the output 120 with the input 125 within the housing 105, wherein rotation of the input 125 causes rotation of the output 125. The input 125 can be coupled to and receive a torque from an external tool, for example a torque or ratchet wrench, and the torque is transferred from input 125 to the output 120, and the output 120 can be coupled to a work piece via a driver 145, or via an accessory coupled to the driver 145, such as a socket, to apply the torque to the work piece.

The housing 105 can be any enclosure having a cavity capable of housing internal components of the tool 100, for example, the input 125, output 120, and the internal gears 140 that operably couple the input and output 125, 120. As shown in FIG. 1, the housing 105 can be a clamshell type housing having first and second portions 105*a*, 105*b* coupled together at a center axis of the housing 105 to allow access to the internal components of the tool 100. The housing 105 can also be a singular body with side openings 106, 107 at the axial ends of the housing 105, as shown in FIG. 2. It will be appreciated that any other housing can be implemented without departing from the spirit and scope of the present application.

The input 125 functions as the input mechanism for the tool 100 and receives a torque from, for example, a torque or ratchet wrench or other suitable tool. For example, a user can insert a lug driver of a torque or ratchet wrench or other suitable tool into the input 125 and apply the input torque to the tool 100. The input 125 and output 120 can be cooperative gear mechanisms, and as such, the input 125 is operably coupled to the output 120 and can transfer the torque to the output 120 via the cooperative intermediate gears 140, as shown in FIG. 1. Alternately, the input 125 and output 120 can be sprockets, and as such, the input 125 can transfer the input torque to the output 120 via a chain 258 (partially shown), as shown in FIG. 2.

The output 120 can include a lug driver 145, similar in shape and size to the lug driver of a conventional torque or ratchet wrench or other tool (e.g., ¼ inch, ⅜ inch or ½ inch), and can transfer torque to an accessory (such as a socket that can be coupled to a work piece). The driver 145 can be permanently or releasably coupled to the output 120 with well-known means, for example a ball detent system, and can be inserted into either or both of the input 125 and output 120, in some embodiments. For example, the driver 145 can include one or more ball detents that engage in respective indents within the input and/or output 120, in some embodiments.

As shown in FIG. 1, the input 125 and output 120 can be gears operatively coupled together via cooperative intermediate gears 140 that meshingly engage each other. The input 125, output 120, and intermediate gears 140 can be any type of gear or gear train, such as a planetary gear train, in-line gear train, spur gears, bevel gears, rack and pinion gears, worm gears, or any combination of the above. The intermediate gears 140 can also be any number of gears, and are not limited to the three gear embodiment shown in FIG. 1. In some embodiments, the input 125 is directly operably coupled to the output 120 with no intermediate gears 140 or chain 258.

The clips 130, 135 can be any structure capable of clipping onto the input 120 and output 125 and holding the input 125 and output 120 respectively within the first opening 110 and second opening 115, while still allowing rotation relative to housing 105. In an embodiment, the clips 130, 135 are spring metal clips or C-clips that engage circumferential grooves on the input 125 and output 120 to retain the input 125 and output 120 within the openings 110, 115.

In an embodiment, and referring to FIG. 2, the first 106 and second 107 side openings can be respectively enclosed by first 260 and second 265 covers. The covers 260, 265 can respectively include first 270 and second 275 cover openings that respectively axially align with first and second openings 110, 115 to allow respective operable access to the output 120 and input 125, when the covers 260, 265 are inserted onto the tool 100. In an embodiment, the covers 260, 265 are made of a flexible material (e.g., rubber or other type of polymer) such that the covers 260, 265 can easily slide over the side openings 106, 107, and can be held in place with a friction-fit, but can still be removed from the tool 100 without requiring a special tool.

Figure 3:
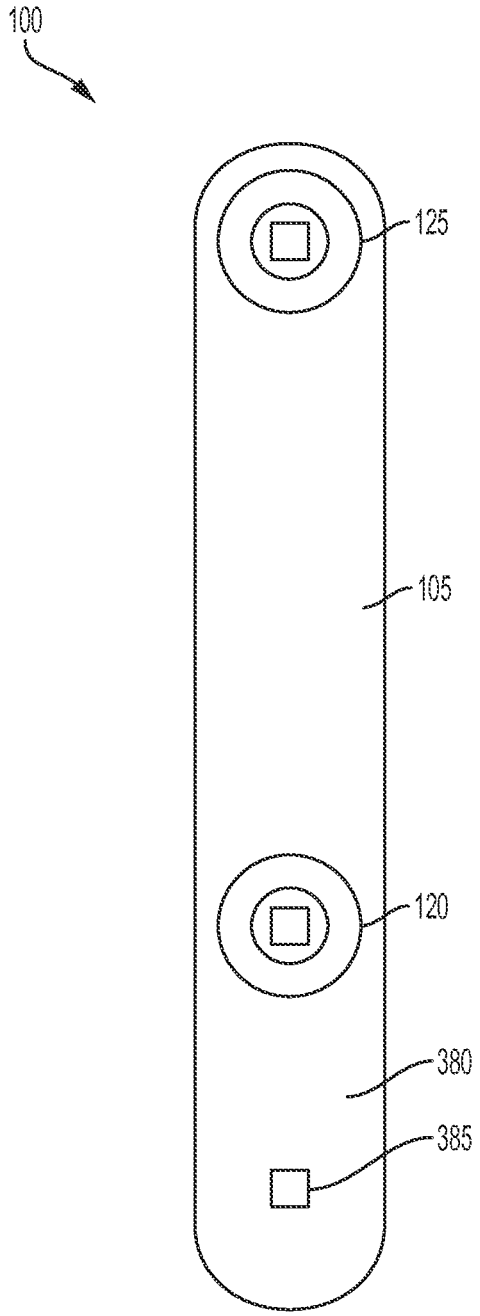
FIG. 3 is a top plan view of a remote wrench according to another embodiment of the present invention.

Referring to FIG. 3, the tool 100 includes similar attributes to the tool 100 discussed above with respect to FIGS. 1 and 2, for example, a housing 105, input 125, and output 120. The tool 100 is sized and shaped to include a handle portion 380 that extends beyond the output 120 or the input 125 and has sufficient area for a user to hold. Optionally, the tool 100 can include a grip at the handle portion 380 for easier handling by the user.

Optionally, a drive 385 can be implemented near the handle portion 380 or away from the handle portion 380. The drive 385 can act as a further extension and be sized and shaped to receive a breaker bar or ratchet attachment, for example, to remove problematic fasteners or for other torque-application purposes. The drive 385 is therefore one example of a connection point, as that term is used within this application, where an external object can connect to the tool 100. As shown, the drive 385 can be spaced from the input 125 and output 120 so as not to interfere with the remote wrench process. Moreover, it will be appreciated that the drive 385 is shown as a square configuration, but it can include any common geometric configuration, such as hexagonal, Phillips®, Torx®, and the like, without departing from the scope and spirit of the present invention.

Figure 4:
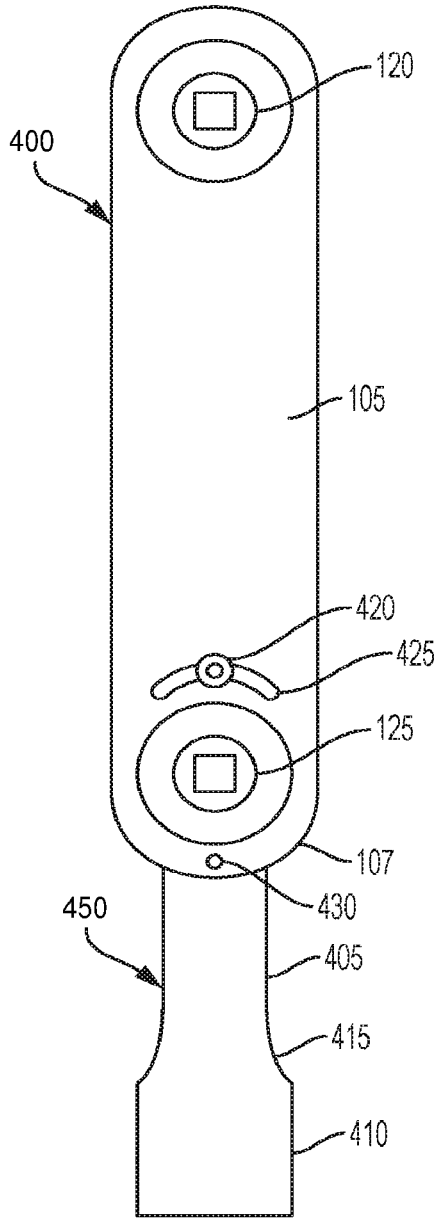
FIG. 4 is a top plan view of a handle and remote wrench according to an embodiment of the present invention.

Referring now to FIG. 4, the tool 400 is similar to tools discussed above, and can include a housing 105, input 125, and output 120. As shown, the tool 400 can couple to an extension handle 450 proximate the second open end 107, but any manner of coupling the tool 400 and handle 450 together can be implemented without departing from the spirit and scope of the present application.

The handle 450 can include an extension 405 and a knob 410 coupled together by a neck 415. The handle 450 can connect to the tool 400 at a locking pin 420 connection point that engages within an arcuate slot 425 and can be secured within the slot 425 to releasably or permanently couple the handle 450 to the tool 400. The slot 425 can extend across the tool 400 in an arcuate manner to allow the handle 450 to rotate relative to the tool 400 at virtually any angle the user desires. The handle 450 can further be coupled to the tool 400 by a joint 430 to ensure the handle 450 is aligned linearly with respect to the linear axis of the tool 400. For example, the joint 430 can be disposed in a center of the tool 400, and the corresponding threads of the handle 450 can be located in the center of the handle 450. Accordingly, when the joint 430 is coupled to the handle 450, the handle 450 is aligned along the same longitudinal axis as the tool 400. For example, the tool 400 can have a tool axis and the handle 450 can have a handle axis, and the tool axis and handle axis can be substantially axially aligned. As shown, the slot 425 and joint 430 can be spaced from the input 125 and output 120 so as not to interfere with the remote wrench process.

Figure 5A:
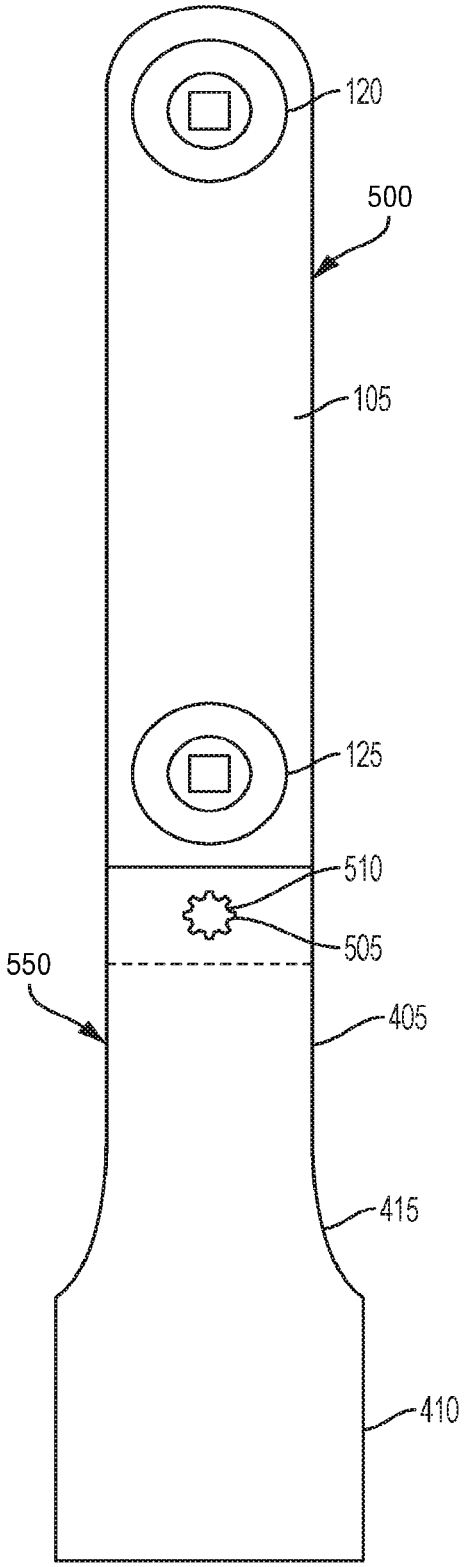
FIG. 5A is a top plan view of a handle and remote wrench according to an embodiment of the present invention.
Figure 5B:
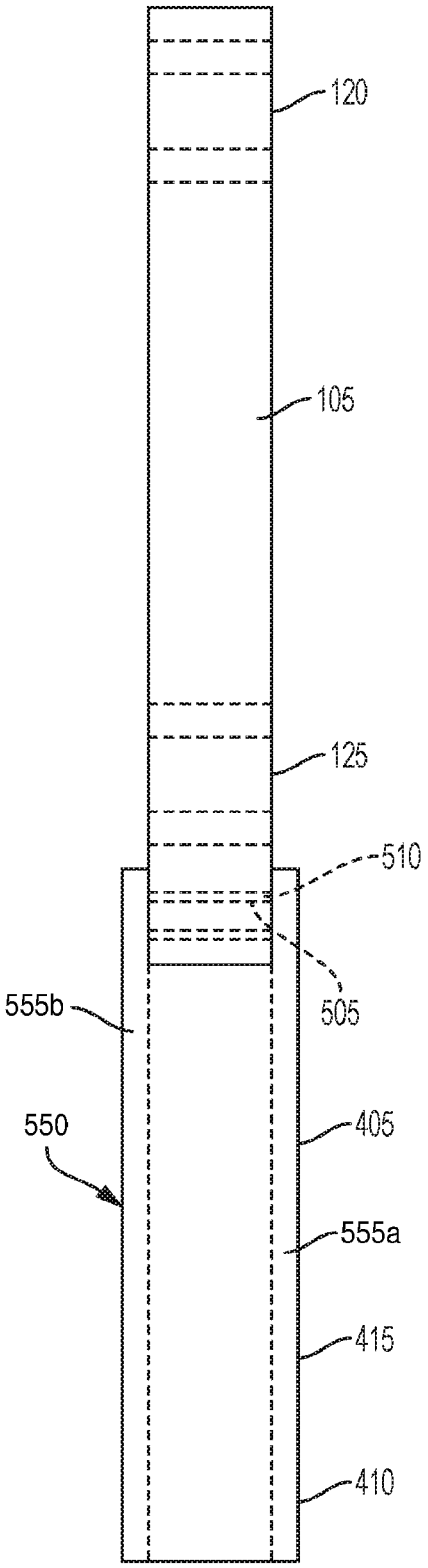
FIG. 5B is a side plan view of the handle and remote wrench shown in FIG. 5A.

Referring now to FIGS. 5A and 5B, the tool 500 includes similar attributes to the tools discussed above, for example, a housing 105, input 125, and output 120. The tool 500 can be coupled to a handle 550 at a connection point by tool teeth 505 or spline and cooperative handle teeth 510. For example, the tool 500 can include tool teeth 505 at the input 125 or output 120 (for example, spline holes in the housing 105) and such tool teeth 505 can releasably or permanently couple with the handle teeth 510 of the handle 550.

As shown, the tool teeth 505 can be a separate component from the input 125 or output 120. However, the input 125 or output 120 themselves can serve as the tool teeth 505 and couple with the handle 550. The tool teeth 505 and handle teeth 510 can also be coupled together and held in place by a tightening mechanism, for example, a threaded fastener that more securely couples the tool teeth 505 and handle teeth 510 together. As shown, the tool teeth 505 and handle teeth 510 can be spaced from the input 125 and output 120 so as not to interfere with the remote wrench process. Any other manner of coupling the tool teeth 505 and handle teeth 510 together can be implemented without departing from the spirit and scope of the present application.

As shown in FIG. 5B, the handle 550 can include a first handle portion 555*a* and a second handle portion 555*b* that respectively extend above and below a top and bottom surface of the tool 500. For example, the handle 550 can be hollow and the first handle portion 555*a* and second handle portion 555*b* can partially house the tool 500, while the tool teeth 505 and handle teeth 510 engage one another to couple the tool 500 to the handle 550. In other embodiments, the housing 105 of the tool 500 can partially house the handle 550 while the tool teeth 505 and handle teeth 510 engage one another to couple the tool 500 to the handle 550. Any other manner of coupling the tool 500 to the handle 550 can be implemented without departing from the spirit and scope of the present application.

As discussed above, the tool can be a remote wrench. However, the tool can be any tool or object, for example, a remote wrench, impact wrench, torque wrench, or other suitable object. The tool need not be a tool at all, and can instead be a piece of sporting equipment, industrial equipment, office equipment, or other type of object that requires a housing. Further, the handles discussed herein need not be handles at all, and can instead be any accessory that couples to a tool.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A tool and accessory combination comprising:

a tool including:

a housing having opposing first and second ends and an arcuate slot extending across the housing;

an input and output respectively disposed proximate to the first and second ends, the input and output are each adapted to rotate relative to the tool, wherein the input is adapted to receive and transfer torque to the output, and the output is adapted to transmit torque to a work piece;

a locking pin adapted to engage the arcuate slot; and an accessory coupled to the tool at the arcuate slot by the locking pin and further coupled to the tool by a joint disposed in the housing, wherein the accessory is rotatable relative to the tool via the joint and fixedly positionable at an angle of rotation by engaging the locking pin within the arcuate slot.

2. The combination of claim 1, wherein the arcuate slot and the locking pin are disposed between the input and output.

3. The combination of claim 1, wherein the joint is disposed between the input and the first end and aligns the tool and accessory along a tool axis and an accessory axis.

4. The combination of claim 1, wherein the input is adapted to engage a drive lug, and the output is adapted to engage the work piece.

5. The combination of claim 1, wherein the input and output are operably coupled together such that rotation of the input causes rotation of the output.

6. The combination of claim 1, wherein the accessory is a handle.

7. The combination of claim 1, wherein:

the accessory is a handle;

the arcuate slot and the locking pin are disposed between the input and output; and the joint is disposed between the input and the first end, the joint aligns the tool and the handle along a tool axis and a handle axis.

8. The combination of claim 7, wherein the tool axis is a longitudinal axis axially extending from the first end to the second end, and the input, the output, and the joint are each axially aligned along the longitudinal axis.

* * * * *